US006291774B1

(12) United States Patent
Williams

(10) Patent No.: US 6,291,774 B1
(45) Date of Patent: Sep. 18, 2001

(54) WILDLIFE GUARD COVER

(75) Inventor: Richard Brent Williams, Houston, TX (US)

(73) Assignee: Reliant Energy Incorporated, Houston, TX (US)

( * ) Notice: Subject to any disclaimer, the term of this patent is extended or adjusted under 35 U.S.C. 154(b) by 0 days.

(21) Appl. No.: 09/310,236

(22) Filed: May 12, 1999

(51) Int. Cl.[7] ..... H01B 17/00; H01B 17/36

(52) U.S. Cl. ..... 174/139; 174/138 R; 174/135; 174/5 R; 174/31 R; 174/151

(58) Field of Search ..... 174/139, 151, 174/31 R, 161 R, 137 R, 138 R, 5 R, 135; 361/604, 618, 232; 49/58, 59; 52/101

(56) References Cited

U.S. PATENT DOCUMENTS

| | | | | |
|---|---|---|---|---|
| 3,192,312 | | 6/1965 | Sauer | 174/209 |
| 3,639,678 | | 2/1972 | Mushcong | 174/145 |
| 3,639,681 | | 2/1972 | Ettlinger | 174/138 F |
| 4,053,707 | | 10/1977 | Ely et al. | 174/209 |
| 4,201,883 | | 5/1980 | Shepherd | 174/139 |
| 4,637,164 | | 1/1987 | Brown | 47/24 |
| 4,731,507 | | 3/1988 | Torimoto | 174/139 |
| 4,845,307 | | 7/1989 | Cumming et al. | 174/5 R |
| 5,023,406 | | 6/1991 | Thornley | 174/209 |
| 5,293,835 | | 3/1994 | Shagoury | 119/57.9 |
| 5,446,242 | | 8/1995 | Barrett | 174/140 R |
| 5,648,641 | | 7/1997 | Guthrie | 174/139 |
| 5,834,686 | * | 11/1998 | Barrett et al. | 174/5 R |
| 5,864,096 | | 1/1999 | Williams | 174/139 |
| 6,005,196 | * | 12/1999 | Spillyards | 174/138 F |
| 6,098,348 | * | 8/2000 | Weaver | 52/101 |

FOREIGN PATENT DOCUMENTS

| | | |
|---|---|---|
| 252351 | of 1912 | (DE) . |
| 679220 | of 1939 | (DE) . |
| 283009 | of 1990 | (DE) . |
| 328365 | of 1989 | (EP) . |
| 396244 | 8/1933 | (GB) . |
| 1542845 | 3/1979 | (GB) . |

OTHER PUBLICATIONS

Animal–Caused Outages, Figures 8.1, 8.16 and 8.20 prepared by Southern Engineering Company Rural Electric Research, National Rural Electric Cooperative Association, Copyright 1996.

Fargo Mfg. Company, Inc., One Piece Wildlife Protector, 1988.

Midsun Group, E/Barrier, 1998.

Raychem Corp., Insulation Enhancement System, 1997.

Raychem, Raysulate Substation Retrofit Application Guide, 1996.

* cited by examiner

*Primary Examiner*—Dean A. Reichard
*Assistant Examiner*—W. Daniel Walkenhorst
(74) *Attorney, Agent, or Firm*—Bracewell & Patterson L.L.P.

(57) ABSTRACT

A wildlife guard for electrical power distribution equipment has two hingedly mounted sections which close together to form a protective cover at the top of an insulator bushing on electrical equipment. The wildlife guard is adapted by its structure to fit a range of bushing sizes and yet provide structural integrity and reliable protection once in place. The wildlife guard also accommodates passage of conductive members such as electrical conductors and sparkgap bars through the cover at locations governed by actual field conditions. The wildlife guard has a cover locking mechanism allowing its easy removal when desired.

34 Claims, 7 Drawing Sheets

WILDLIFE GUARD COVER

SPECIFICATION

BACKGROUND OF THE INVENTION

1. Field of the Invention

The present invention relates to protective wildlife guards for electrical power distribution equipment.

2. Description of the Related Art

Distribution equipment used to supply electrical power has used wildlife protection guards or covers to prevent wildlife from simultaneously contacting energized and grounded surfaces. If such contact occurred, short circuits and consequent power outages frequently were the result. Service interruptions are undesirable to both customers and the electrical utility. Even momentary service interruptions are a nuisance for customers because they have required customers to reset digital clocks and other such devices. For utilities, service interruptions have required field service personnel to replace blown fuses and to repair or replace damaged equipment. For example, a circuit breaker in a substation and thus for an entire circuit might operate and hundreds of customers could have service interrupted as a result of a single wildlife-caused short circuit. Manufacturing facilities with sensitive processes often cannot tolerate even momentary power interruptions. For these reasons, wildlife protection guards or covers were developed to protect vulnerable energized parts of distribution equipment.

There have generally been two types of wildlife guards. One such type of guard is a generally disk- or plate-shaped barrier. Commonly owned U.S. Pat. No. 5,864,096 issued Jan. 26, 1999, is an example of the disk or plate type wildlife guard. The other type of guard is of a hinged cover or enclosure type which was fitted over a portion of the equipment and secured there. There have been several commercially available products of the enclosure type. However, there have been several problems with these types of enclosures.

Sparkgap bars or probes are sometimes provided near the bushing terminal connection of the electrical conductors to the distribution equipment, such as transformers. They are normally used in areas with heavy environmental contamination, such as coastal areas which have salt contamination. The sparkgap bars serve to provide external air gaps between the equipment bushing and the surge arrester. Without the air gaps, leakage currents on the contaminated surfaces of the arresters will cause spurious sparkovers of many arresters and this can cause many arresters to fail prematurely. The air gaps provided by the sparkgap bars serve to isolate the arrester from the energized phase conductors, but only during normal operating voltage conditions. When lightning surge voltages occur, the sparkgap bars sparkover in order to shunt lightning surge current away from the protected equipment and through the surge arrester thus protecting the equipment.

When wildlife guards were installed, the cover would serve as an insulative barrier, preventing a sparkover of a sparkgap unless access through them was provided. Certain wildlife guards provided weakened areas at certain specific locations in the walls of the covers. Line crew members could then cut, punch out or otherwise remove a portion of the cover wall at one of these locations during installation. The resultant hole or gap in the cover allowed sparkgap bar passage through the wall if the location of the sparkgap bar coincided with one of the pre-designed locations.

Unfortunately, field conditions vary widely and the sparkgap bar locations with respect to the electrical equipment bushing geometry could often vary widely. There was no way, so far as is known, to know in advance the area where a portion of the wall of the wildlife cover would need to be removed in order to permit sparkgap bar access through the wall of the cover. Line crews might often attempt to improvise and use some makeshift solution, such as bending the sparkgap bar or force-fitting the cover in place. Unfortunately, bending the sparkgap bar increases the air gap distance which increases the sparkover voltage which can cause failure of the protected equipment. Also, the covers might later work loose and leave the electrical connection exposed. If the temporary makeshift measures became ineffective, the wildlife protective function for which the covers were intended was thus defeated.

At times during usage, it also may have been necessary to remove the wildlife protective cover once installed. Examples would include removal in order to have access to the electrical equipment in order to disconnect the equipment. The housings of the covers were required to be firmly closed by some mechanical locking mechanism when installed. This was done in order to prevent their coming inadvertently loose and failing in their protective function. Unfortunately, the lock mechanisms of previous cover designs keep lock mechanism parts under mechanical stress. This frequently has caused the lock mechanisms to break over time, especially in cold weather conditions where the cover material normally becomes more brittle. When the lock mechanisms break, the covers open and their protective purpose is defeated.

A number of the presently available cover type housings were difficult to remove. The covers did not have lock release mechanisms and were difficult to grasp once installed because the bottom opening of the cover was often inaccessible between insulator skirts. For this reason, large amounts of effort were often required to open the locking mechanism. Line crew members would often be required to grasp the cover with both hands and compress or otherwise distort the shape of the cover in order to force the latch mechanisms open. In addition, if at times too much force was exerted, cover locking mechanism would be broken on opening it. This rendered the wildlife cover unsuitable for further use.

In other installation conditions, the conductor would be arranged on the equipment so that it extended horizontally both to and away from the connection to the equipment. Since the protective cover wildlife guards were typically hinged, this presented a problem. The conductors could not be installed through the pivotable sidewalls of the cover, since the sidewalls needed to move in order to close the cover in place when installed. The hinge areas of the pivotable covers typically were of considerable height along the cover walls. The hinges thus made installation of covers difficult in these situations. Again, the line crew would be forced to use makeshift measures or improvisations.

Protective enclosure type wildlife guards were normally mounted on insulative skirts of transformer bushings to protect the electrical connection of the power conductor to the transformer. For a given electric utility or power company, there were a wide variety of inner diameter or cores and outer skirt diameters for bushings on the different types of power distribution equipment in use. Thus, to accommodate the range of outer skirt diameters, a range of sizes of covers was required to be carried on line crew or service trucks, where storage space at a premium. Unfortunately, this failed to accommodate the range of inner diameter or cores. Later, there were attempts to make bottom closure walls flexible in these enclosure covers to accommodate the range of core and skirt diameters. This may have reduced the number of sizes of covers required by some utilities. However, the strength and structural integrity of the cover suffered in the areas where flexibility was offered to accommodate some bushing sizes where the inner diameter or core was only slightly less than the outer skirt diameter. In these cases, the flexible portions were too large and would permit the cover to come loose from its insulative bushing and again defeat the wildlife protective purpose of the cover. Furthermore, the inner opening of the flexible bottom closure wall was frequently too small for the bushing core diameter to allow closure of the cover around the bushing.

SUMMARY OF THE INVENTION

Briefly, the present invention provides a new and improved wildlife guard for enclosing a connection to electrical power distribution equipment. The wildlife guard according to the present invention has first and second wall members which are adapted to be joined along contact surfaces. When the wall members are so joined, they form a protective wildlife cover which encloses the connection to the equipment. The wall members have aligned entry slots formed for passage of a conductor, such as wire, spark gap bar or the like, into an interior portion of the cover. Hinge members pivotally connect the first and second wall members along one of the contact surfaces. The entry slots have yieldable resilient fingers formed in them so that the wire or other structure can pass into the interior of the cover and yet close about the entering structure to seal the interior of the cover.

The entry slots are of a size allowing a range of locations of entry of the wire to accommodate a variety of field conditions. The entry slots are also located in the wall members on opposite sides of the cover to permit electrical pass-through or zero length connections and yet allow the guard to be installed without improvisation and removed without damage to it.

The wildlife guards of the present invention are provided with a new and improved lock or closure mechanism. The lock mechanism includes a flexible, resilient member which flexes to allow closure and opening of the protective wildlife cover. The lock mechanism is such that, when the wildlife cover is in the closed position, the cover is locked closed, but the flexible, resilient member is in a relaxed, stress-free state. Thus, even in cold weather, when the insulating cover material becomes more brittle, the lock mechanism remains viable and the protective purpose of the cover is maintained. The lock mechanisms of the present invention are such that the flexible, resilient members of each lock flex toward one another, thus allowing a line crew member to open the cover with two fingers of a single hand, thus allowing the opening of the cover with a minimum of effort and time. The cover is also preserved for future use. The wildlife guards are thus easy to be installed and removed by a line crew member.

The wildlife guards of the present invention are also provided with bottom wall or closure members which can be easily fitted to a variety of insulative bushing sizes. Thus the wildlife guards of the present invention can be adapted to accommodate a range of insulative bushing skirts of various outer diameters and inner core diameters, as well. The wildlife guards of the present invention are also provided with a resilient yieldable central top opening to allow an incoming conductor to pass into the cover for connection. Further, top portions of the wildlife guard are made easily removable to allow conductors, fuses or other equipment of various sized to be connected within the cover.

DETAILED DESCRIPTION OF INVENTION

Figure 1:
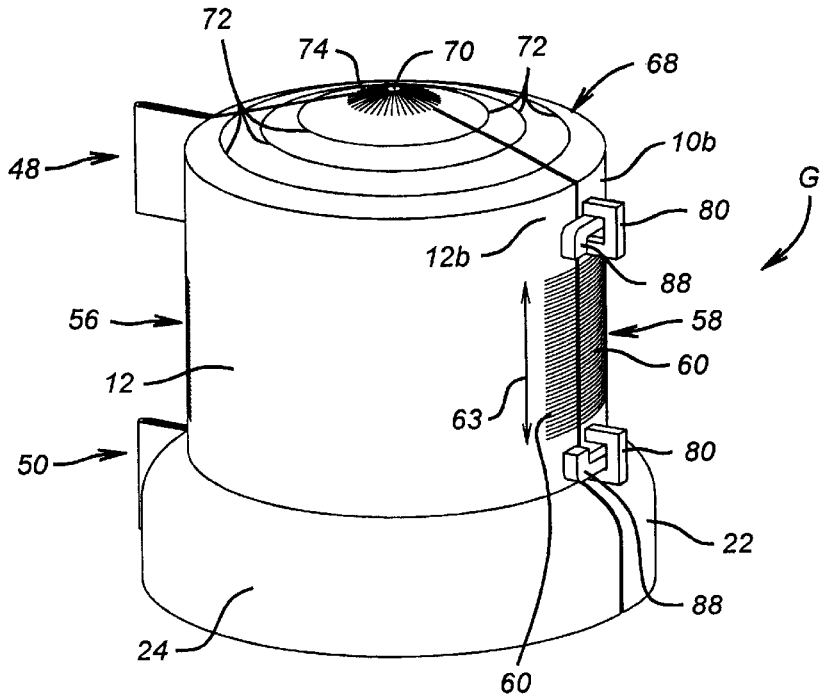
FIG. 1 is an isometric view of a wildlife guard according to the present invention.

In the drawings, the letter G designates generally a wildlife guard for enclosing a connection to electrical power distribution equipment. The electrical power distribution equipment may be any of numerous forms, including transformers and lightning arresters. Thus, the wildlife guard of the present invention may be installed at locations such as on an insulative arrester bushing A (FIG. 6) on a lightning arrester or an insulated transformer bushing B (FIGS. 7–9) on a power distribution transformer. Typically, different ones of these bushings have different diameters at outer skirt portions S and inner core portions C.

The wildlife guard G is typically formed as an integrally molded unitary piece of a suitable insulative synthetic resin, such as UV stabilized polypropylene. The wildlife guard G includes a first generally cylindrical wall member 10 and a second generally cylindrical wall member 12. The wall members 10 and 12 are generally half-cylinders, having mating contact surfaces or closure edges 14 and 16, respectively, facing each other along vertically extending inner edges 18 and 20. The wall members 10 and 12 of the wildlife guard G are closed together (FIGS. 1 and 3–5) so that their contact surfaces 14 and 16 are engaged, to form a wildlife protective cover. The wildlife protective cover when so formed encloses the connection of a conductor or conductors to the power distribution equipment, typically on the insulative bushing A or B.

The wall members 10 and 12 each have an enlarged outwardly extending lower skirt extension or portion 22 and 24, respectively, formed extending below lower portions 26 and 28. The enlarged lower skirts 22 and 24 each have side walls 30 below an outwardly curving upper portion 32. The enlarged lower skirts 22 and 24 are selected to have inner diameters within the cylindrical side walls 30 compatible with the largest outer diameter skirts. Thus, smaller diameter bushings can easily be enclosed within the cover formed when the wall members 10 and 12 are closed together (FIG.

1). There is no requirement to have several different diameter covers with the wildlife guard G of the present invention.

A semi-circular base or lower bottom disk member 34 is formed extending inwardly across a semi-circular opening 36 formed below the first and second wall members 10 and 12 within each of the cylindrical side walls 30. The central opening 36 of each base disk 34 allows the wildlife guard G to be fitted onto an insulative bushing to form the wildlife protective cover. The radius of the semi-circular openings 36 are chosen to be capable of fitting onto the smallest outer diameter inner core portion C encountered in field conditions. Thus, the cover can be fitted onto small insulative bushings and yet accommodate a variety of diameters of insulative bushing outer skirt portions S.

The base member 34 is in the form of a suitable number of concentrically spaced flat ring members 40,42 and 44 extending outwardly from the central opening 36. Each of the ring members 40, 42 and 44 is connected to the next adjacent outer ring by a set of spacer members 46. The ring members 40, 42, and 44 as well as the spacer members 46 are of a suitable thickness, such as 0.125 inch. This is to allow for structural integrity and strength when the cover formed by the wildlife guard G is in place. Thicknesses of such dimensions are, however, cuttable by conventional shears used by line crew members.

Figure 6:
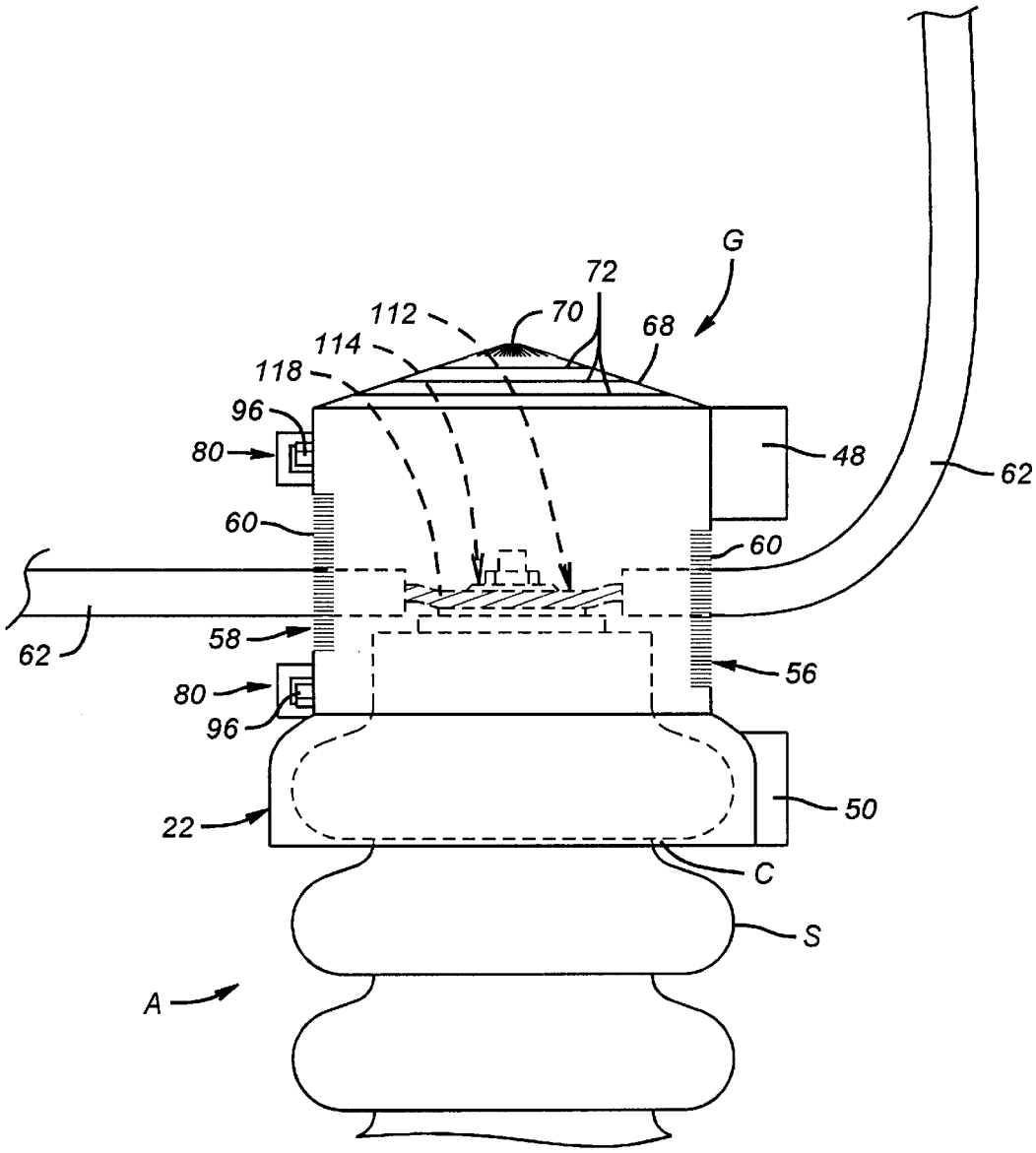
FIG. 6 is a side elevation view, taken partly in cross-section, of the wildlife guard of FIG. 1 installed on an arrester bushing to permit connection between a power line and a transformer.
Figure 7:
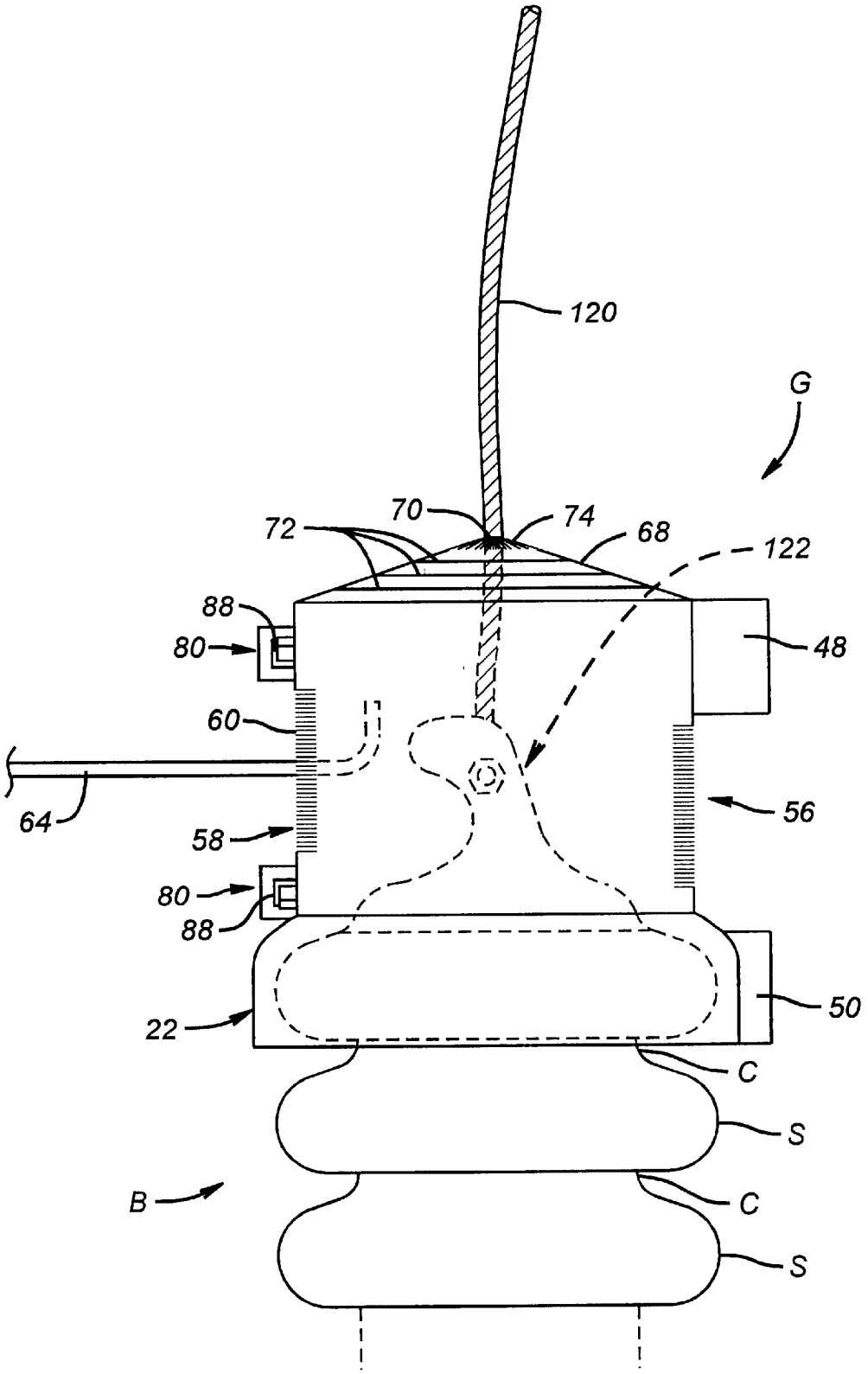
FIG. 7 is a side elevation view, taken partly in cross-section, of the wildlife guard of FIG. 1 installed on a transformer bushing near an arrester spark gap bar.
Figure 8:
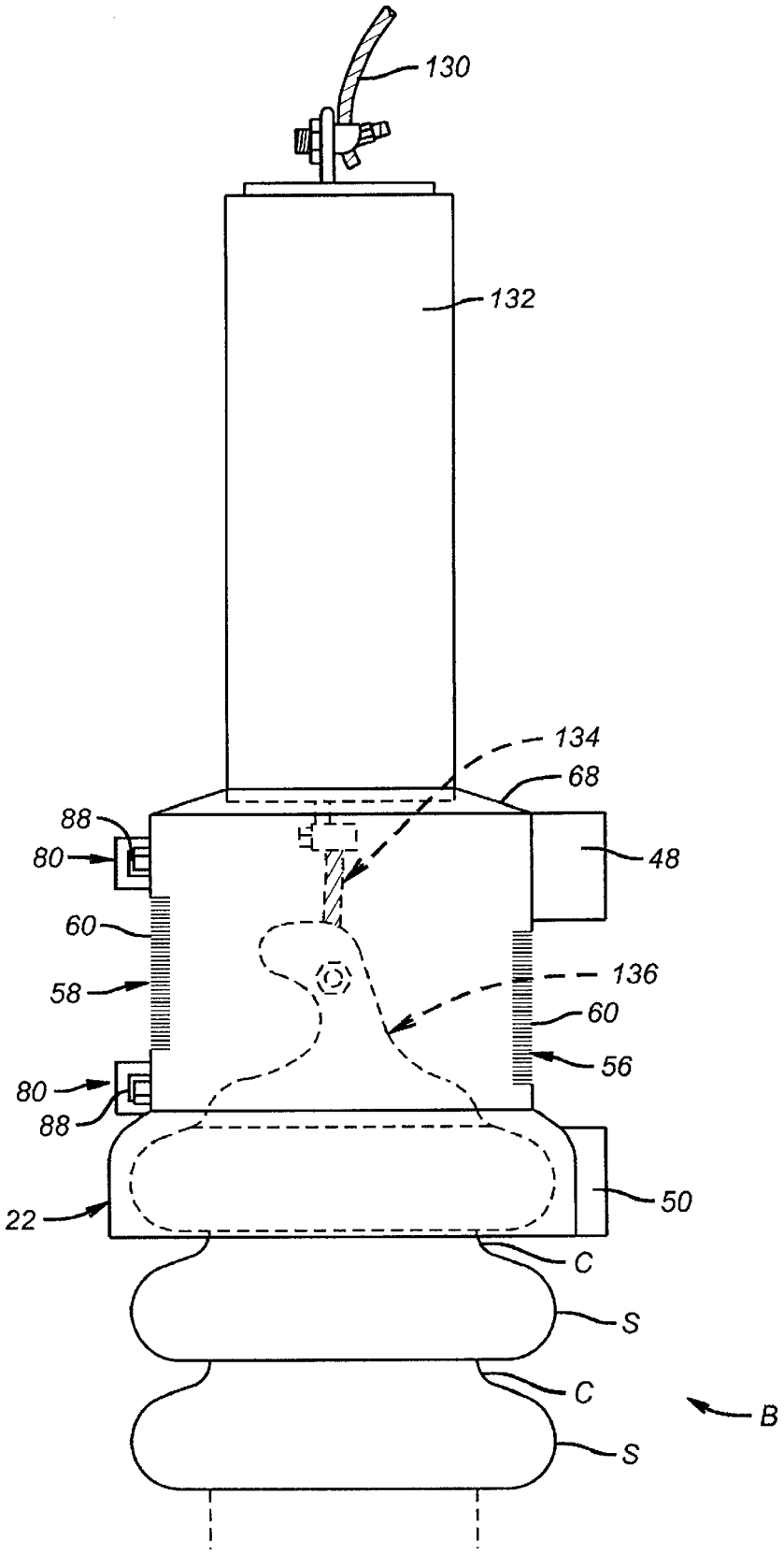
FIG. 8 is a side elevation view, taken partly in cross-section, of the wildlife guard of FIG. 1 installed on a transformer bushing to accommodate connection of a current limiting fuse.

Accordingly, when an insulative bushing is encountered having a larger diameter at an inner core C than the opening 36, selected portions of the base 34 such as one or more ofthe ring members 40 and 42 may be removed to fit the guard G as a cover onto the larger core diameter insulated bushing. Thus, the guard G can be fitted onto a variety of core diameters and skirt diameters in insulative bushings. When installed, the remaining portions of base member 34 fit between insulative bushing skirts (FIGS. 6–8). This provides structural integrity for protection by the wildlife guard G.

Vertically spaced upper and lower hinge members 48 and 50 of the wildlife guard G are formed to pivotally connect wall members 10 and 12 adjacent their respective edge surfaces 14 and 16. The hinged members 48 and 50 are V-shaped and are preferably formed of the same synthetic resin, integrally molded as a part of the wildlife guard G.

Figure 2:
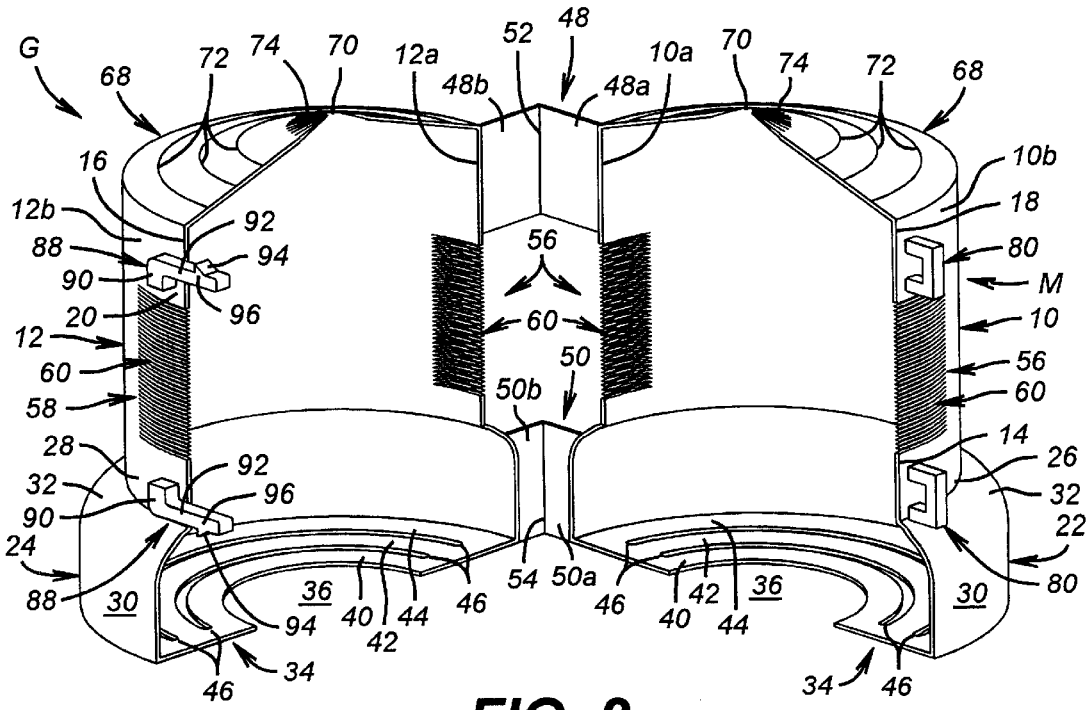
FIG. 2 is an isometric view of the wildlife guard of FIG. 1 in an open position.

The upper hinge member 48 is preferably formed extending between upper end portions 10*a* and 12*a* of wall members 10 and 12 extending outwardly in two plates 48*a* and 48*b* which are joined together along a vertically extending resilient flexure seam 52. The hinge plates 48*a* and 48*b* of the upper hinge member 48 are pivotally movable along the flexure seam 52 to allow the wall members 10 and 12 to move between an open position (FIG. 2) and a closed position (FIGS. 1 and 3–5).

Similarly, the lower hinge member 50 is preferably formed at lower end portions 22*a* and 24*a* of skirt extensions 22 and 24, respectively, of wall members 10 and 12. The lower hinge member 50 has two outwardly extending plates 50*a* and 50*b* which are joined together in a vertically extending resilient flexure seam 54. The hinged plates 50*a* and 50*b* of the lower hinge member 50 are pivotally movable along the flexure seam 54 to allow the wall members 10 and 12 to move between the open and closed positions.

A set of diametrically spaced, vertically aligned entry slots 56 and 58 are formed in the wildlife guard G along each ofthe wall members 10 and 12 adjacent their respective closure surfaces 14 and 16. The entry slot 56 is located in the wall members 10 and 12 between the hinges 48 and 50. With the entry slot 56 located between the hinge members 48 and 50 of the wall members 10 and 12, the wall members 10 and 12 are freely pivotally movable with respect to each other even when a conductive member such as the electric conductor 62 extends into the entry slot 56. This makes the wildlife guard G easy to install and remove from power distribution equipment. Entry slot 58 is located diametrically opposite slot 56, along the portions of the wall members 10 and 12 which open and close to form the protective cover. Typical dimensions for entry slots 56 and 58 are 2.125 inch by 1.5 inch and 1.75 inch by 1.5 inch, respectively.

The entry slots 56 and 58 are not, however, open spaces or ports. In each of the entry slots 56 and 58, a set of fingers 60 are formed. The fingers 60 extend inwardly into each of the entry slots and fit around a conductive member or members, such as 62 or 64, which pass into the cover. In the absence of passage of such a conductive member, the resilient fingers 60 otherwise seal the respective entry slots 56 and 58.

The finger members 60 are pliable, resilient fingers, contiguous with and normally making longitudinal contact with each other along their vertical extent over the entry slots 56 and 58. The fingers 60 are preferably integrally formed with the remaining portions of the wildlife guard G of the same suitable synthetic resin. The resilient fingers 60 are thus pliable, allowing entry of a conductive member such as an insulated electric conductor 62 (FIG. 6) or a spark arrester gap bar 64 (FIG. 7) into the interior of the cover C.

Although not routinely carrying electric current, the spark arrester gap bar 64 is considered a conductive member for the purposes of the present invention. When serving its intended purpose, the spark arrester gap bar 64 is conducting lightning surge current. Thus, according to the present invention, a conductive member is some form of electrically conductive material which must have access to the interior of the protective cover C in order to serve its intended purpose of actually or potentially carrying flow of electric current during its normal usage. In the case of electrical wires, this is while carrying normal load current and/or lightning surge current. In the case of spark arrester gap bars, it is the surges of current caused during lightning surges or the like.

In such a case, there are usually about eight to twelve finger members 60 per longitudinal inch in each of the entry slots 56 and 58. Typically, each of the finger members 60 is approximately 0.75 inch long and of 0.1 inch cross-sectional width.

Each of the entry slots 56 and 58 is formed in the wall members 10 and 12 extending a vertical dimension indicated by an arrow 63 to allow passage of a conductive member into the interior at a range of elevations along the vertical extent of the wildlife guard G. The entry slots 56 and 58 also extend laterally a width indicated by an arrow 65 (FIG. 3) to allow passage of conductive members of various widths, such as spark gap bars 64 and conductor 62.

The entry slots 56 and 58 with the resilient fingers 60 allow the cover formed by the wildlife guard G to accommodate a wide variety of field conditions during installation. The vertical extent of the slots 56 and 58 and the flexibility of the fingers 60 afford a range of heights or elevation locations along the guard G for receiving conductive members. There is no limitation or restriction of the location of entry to preformed hole areas for entry of the conductive members. Further, the slots 56 and 58 and the fingers 60 accommodate a variety of sizes of conductive members (diameter, width, height, thickness) with no need for cutting or removal of portions of the wall.

The wildlife guard G includes a top portion 68 extending upwardly and inwardly from the upper end portions 10*a* and 12*a* of the wall members 10 and 12. The top portion 68 is preferably formed by molding of the same material with the other portions of the wildlife guard G. The top portion 68 may be conical as shown, or domed, or spherical in shape, as well. A central upper region or port 70 is formed at an upper edge portion of the top 68 for entry of conductive members into the interior of the cover formed by wildlife guard G. The top 68 is preferably of comparable thickness to the rings of bottom disk member 34. A set of circumferentially extending grooves 72 of decreasing diameter are formed in the top portion 68 along its upward extent. The grooves 72 permit portions of the top 68 to be removed to accommodate passage of different sizes of fuses, into the interior of the cover C for electric connection purposes.

Figure 10:
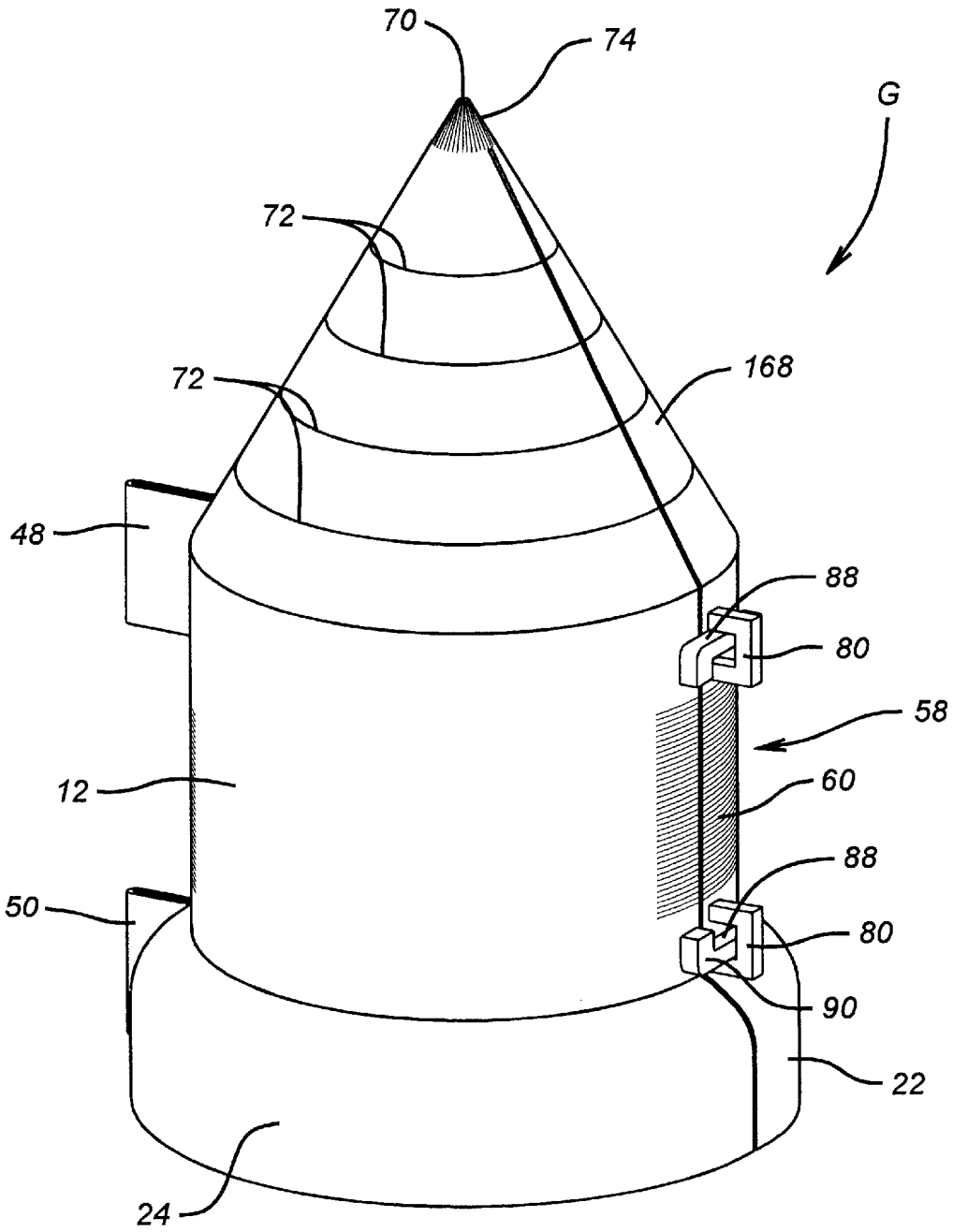
FIG. 10 is an isometric view of an alternate embodiment of a wildlife guard according to the present invention.

A set of inwardly extending, resilient yieldable fingers 74 are formed at upper ends of the top portions 68 extending inwardly. The fingers 74 normally provide a closure for opening 70 in the absence of an electric conductive member. The fingers 74, however, in a like manner to the fingers 60, yield and permit entry of conductive members into the cover. If desired, the top portion 68 may be a variety of heights, such as indicated at 168 in FIG. 10 for use in various conditions, such as on insulative bushings where line crew members use a bare conductor instead of an insulated conductor, such as 62. The additional height provided by taller top portion 168 increases the distance from the top of grounded surfaces, such as the top of overhead type power distribution transformers, to the bare, energized conductor protruding through the opening 70.

The wildlife guard G is provided with a lock mechanism M which permits ease of installation and removal on electrical power equipment. The lock mechanism M includes receiving channel member 80 extending outwardly from an outer surface 10*b* of the wall member 10. The channel members 80 are preferably integrally formed of the same material with the other portions of the wildlife guard G. Preferably two channel members 80 are used, one above and one below the entry slot 58. The channel members 80 are in the form of inverted U-shaped members, defining a slot or passage 82 between side leg or post portions 84 and below or within a transverse central beam 86.

The lock mechanism M also includes a locking tongue member 88 for each locking channel member. The locking tongue member or members are formed on an outer surface 12*b* of wall member 12 at locations corresponding to the location ofthe locking channel members 80. Preferably two locking tongue members 88 are used, located above and below the entry slot 58. The locking tongues 88 are preferably formed and molded of the same electrically insulative synthetic resin as the other portions of the wildlife guard G.

Figure 3:
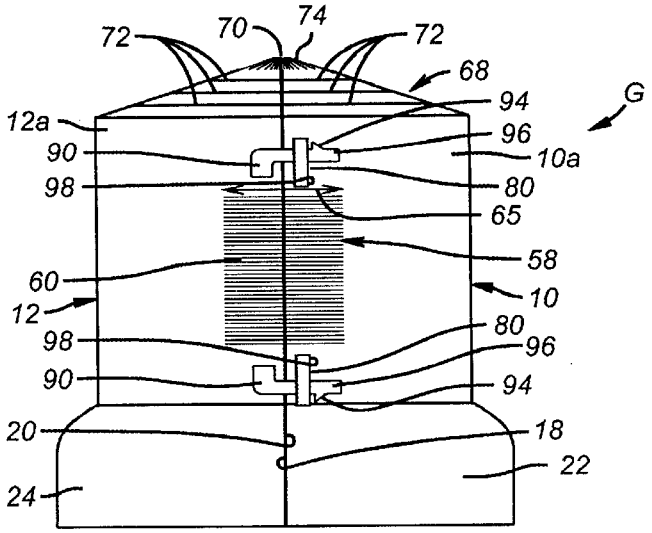
FIG. 3 is a front elevation view of the wildlife guard of FIG. 1.
Figure 4:
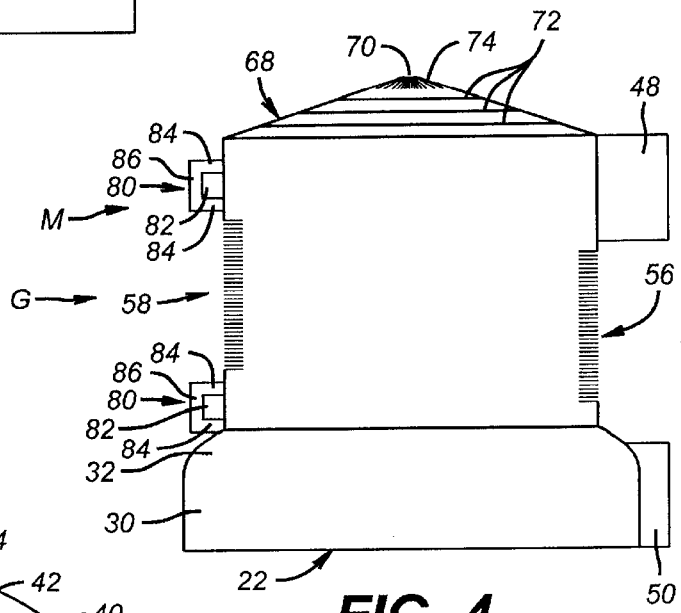
FIG. 4 is a side elevation view of the wildlife guard of FIG. 1.
Figure 5:
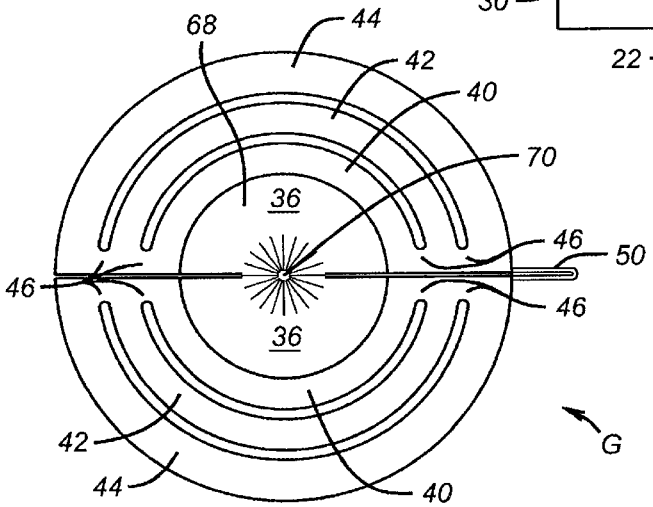
FIG. 5 is a bottom view of the wildlife guard of FIG. 1.

The locking tongues 88 include a base portion 90 extending outwardly from the outer surface 12*b* of the wall member 12. A laterally extending tongue or finger 92 is formed extending from base portion 90 toward channel member 80. The tongue 92 is located on the wall member 12 so as to pass into and through the slot 82 in the correspondingly located receiving channel member 80 when the wall members 10 and 12 are closed together or joined. A detent or stop 94 is formed on an inner end 96 of the locking tongue 88. The detent 94 extends outwardly to engage a stop surface 98 on the channel member 80. When the wall members 10 and 12 are being joined, the detent 94 deflects to slide around the side leg or post portions 84 and then resiliently flexes back to engage the surface 98 (FIG. 3) and locks the wall members 10 and 12 of the guard securely in place in the closed position (FIGS. 3–5).

The tongue 92, being formed of a synthetic resin, is adequately yieldable to be easily depressed by one finger of a crew member a sufficient amount to move the detent 94 out of engagement with the channel member 80 and permit unlocking of the locking mechanism M. Tongue members 92 are such that they can be flexed toward one another with two fingers of a single hand in order to open the cover.

In the operation of the present invention, the wildlife guard G can be easily installed on a wide variety of electrical power distribution equipment. For example, a wildlife guard G is shown in FIG. 6 in what is known as a zero lead length connection. The connection made in FIG. 6 is accomplished on an insulative arrester bushing A. The connection of FIG. 6 allows conductors from a fused cutout to enter and leave the cover C in the same general common horizontal plane.

The insulative conductor 62 extending downwardly from a fuse cutout bends inwardly and extends generally in a substantially horizontal plane for passage through fingers 60 into the entry slot 56. Because the entry slot 56 is located between the hinges 48 and 50, the presence of conductor 62 does not impede operation of such hinges.

A portion 112 of the conductor 62 inside the cover C has the insulation removed for connection to a convention conductor clamp 114 on an arrester. Insulated conductor 62 continues through the fingers 60 of entry slot 58 in the same general horizontal plane as that of the entry of conductor 62 into the wildlife guard G. Since entry slot 58 is formed along the contact surfaces 14 and 16, the presence of conductor 62 does not impede opening or closing of the wall members 10 and 12 along their respective closure surfaces 14 and 16.

Thus, because of the location of the entry slots 56 and 58 with respect to the hinges 48 and 50, the pivotable wall members 10 and 12 may be moved with respect to each other after the conductor 62 is inserted into the entry slot 56. Further, the wall members 10 and 12 may be pivoted and closed at the entry slot 58 about the conductor 62 after its exposed conductor portion 112 is connected to the conductor clamp 114.

The wildlife guard G is shown in FIG. 7 installed on an insulated transformer bushing stack B of the type present atop a power distribution transformer. A bare conductor 120 extending from a fused cutout is inserted through fingers 74 and opening 70 in the top portion 68. The conductor 120 is connected to a connector on the metal bushing cap 122 atop the bushing stack B. A conductive member, in the form of the metal spark gap bar 64, extends from an arrester bushing and passes through the fingers 60 of the entry slot 58. In the position shown, the spark gap bar 64 is within the cover C at the required spacing from the bushing cap 122 for lightning arrester purposes. It is to be noted that the connection of the conductor 120 and on the connector of the cap 122, as well as the position of the spark gap bar 64 are all within the cover formed by the wildlife guard G.

The wildlife guard G of the present invention is shown in FIG. 8 installed on another form of insulative transformer bushing stack B, such as is typically present atop a power distribution transformer. A conductor 130 extending from a fused cutout is connected to a conventional current limiting fuse 132. Certain portions of the top 68 of the guard G have been cut away and removed, such as at grooves 72, to allow ease of entry of the fuse 132 into the interior of the cover C. The current limiting fuse 132 is connected by an adapter 134 to a metal bushing cap 136.

Figure 9:
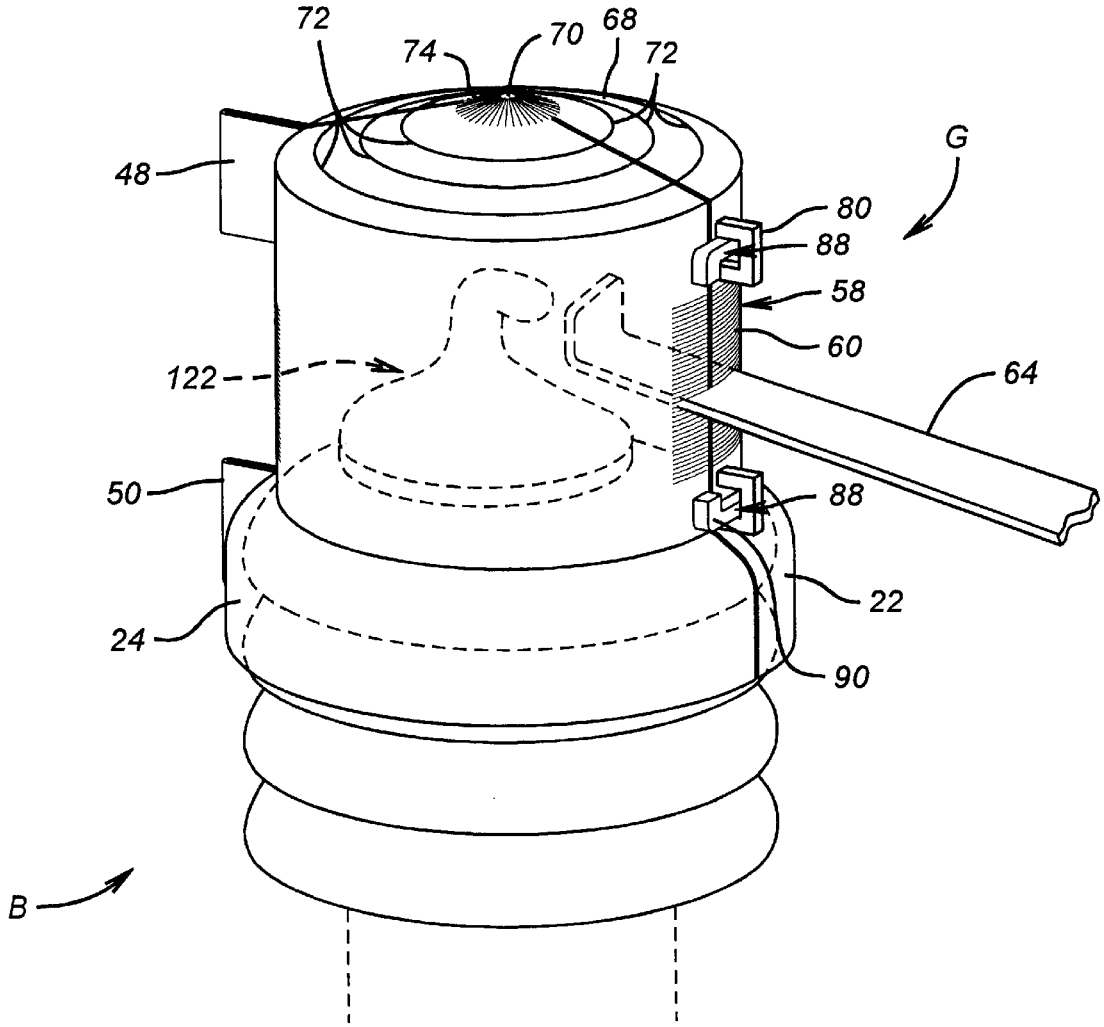
FIG. 9 is an isometric view of the wildlife guard of FIG. 1 installed on a transformer bushing near an arrester spark gap bar.

The wildlife protective guard G ofthe present invention is shown in FIG. 9 installed on an insulative transformer bushing stack B like that of FIG. 7. The spark gap bar 64 of the like configuration and structure to that of FIG. 7 is shown entering through fingers 60 of entry slot 58. The power conductor 120 and a conventional connector on the bushing terminal 122 are not shown, although they would be present in actual use.

From the foregoing, it can be seen that the wildlife guard G is adapted by the location of its entry ports 56 and 58 and opening 70 to receive conductors for connection at a variety of locations. The fingers 60 in entry slots 56 and 58 accommodate conductive members of various sizes and over a flexible range of positions. Opening and closing of the wildlife guard G is not impeded by the presence of conductors. The wildlife guard G is also adapted for use with a variety of sizes of insulative bushings, both skirt and inner core diameters. Further, the locking mechanism M is easily engaged or disengaged in the field.

The foregoing disclosure and description of the invention are illustrative and explanatory thereof, and various changes in the details of the illustrated apparatus and construction and method of operation may be made without departing from the spirit of the invention.

What is claimed is:

1. A wildlife guard for enclosing a connection on an insulative bushing to electrical power distribution equipment, comprising:

a first wall member and a second wall member adapted to be joined along contact surfaces to form a wildlife protective cover enclosing the connection to the equipment;

a base member extending inwardly below the first and second wall members;

the base member having an opening formed in it for fitting the cover onto the insulative bushing;

the base member comprising:

a plurality offering members concentrically located about the opening for the insulative bushing;

spacer members mounted between the ring members for connecting the ring members;

a plurality of aligned entry slots formed in the wall members for passage of a wire into an interior portion of the cover; and a set of hinge members pivotally connecting the first and second wall members along one of the contact surfaces.

2. The wildlife guard of claim 1, wherein the entry slots are formed along a portion of each of the wall members adjacent their contact surfaces.

3. The wildlife guard of claim 2, wherein the entry slots in the wall members are aligned with their contact surfaces when the wall members are joined.

4. The wildlife guard of claim 1, further including:

a set of yieldable resilient finger members formed in each of the wall members extending into the entry slots, the yieldable finger members fitting around a conductive member passing into the cover but otherwise sealing the entry slots.

5. The wildlife guard of claim 1, wherein the hinge members are located at positions on the wall members separated from each other by one of the entry slots.

6. The wildlife guard of claim 1, wherein the entry slots are aligned in a common horizontal plane through the wall members.

7. The wildlife guard of claim 1, wherein each of the wall members is a cylindrical wall.

8. The wildlife guard of claim 7, wherein the entry slots are formed on diametrically opposite portions of the cylindrical walls of the wall members.

9. The wildlife guard of claim 7, wherein the entry slots are formed on diametrically opposite contact surface portions of the cylindrical walls of the wall members.

10. The wildlife guard of claim 7, wherein each ofthe wall members includes an enlarged lower skirt portion below the cylindrical wall.

11. The wildlife guard of claim 7, wherein each of the wall members includes a top portion above the cylindrical wall.

12. The wildlife guard of claim 11, wherein an opening is formed at an upper end of the top portion of the wall member.

13. The wildlife guard of claim 12, further including:

a set of yieldable resilient fingers formed in the opening at the upper end of the top portion of the wall member.

14. The wildlife guard of claim 12, wherein the top of the wall member has a set of circumferential grooves of different diameter formed in it for removal of portions of the conical top to enlarge the opening.

15. A wildlife guard for enclosing a wire connection on an insulative bushing to electrical power distribution equipment comprising:

a first wall member and a second wall member adapted to be joined along contact surfaces to form a wildlife protective cover enclosing the connection to the equipment;

a base member extending inwardly below the first and second wall members;

the base member having an opening formed in it for fitting the cover onto the insulative bushing;

a plurality of ring members concentrically located about the opening for the insulative bushing;

spacer members mounted between the ring members for connecting the ring members;

a plurality of aligned entry slots formed in the wall members for passage of a wire into an interior portion of the cover; and a set of yieldable resilient finger members formed in each of the wall members extending into the entry slots, the yieldable finger members fitting around a conductive member passing into the cover but otherwise sealing the entry slots.

16. The wildlife guard of claim 15, wherein adjacent ones ofthe yieldable fingers are in contact with each other along their inward extent to form a part of the wall member in the absence of presence or a conductive member in the entry slot.

17. The wildlife guard of claim 16, wherein the yieldable fingers are pliable and separable from each other on insertion of a conductive member into the entry slot.

18. The wildlife guard of claim 15, wherein each of the wall members includes a top portion above the cylindrical wall.

19. The wildlife guard of claim 18, wherein the top portion includes a conical top portion above the cylindrical wall.

20. The wildlife guard of claim 19, wherein an opening is formed at an upper end of the conical top of the wall member.

21. The wildlife guard of claim 20, further including:

a set of yieldable resilient fingers formed extending into the opening at the upper end of the conical top of the wall member.

22. The wildlife guard of claim 20, wherein the conical top of the wall member has a set of circumferential grooves of different diameter formed in it for removal of portions of the conical top to enlarge the opening.

23. A wildlife guard for enclosing a wire connection to electrical power distribution equipment, comprising:

a first wall member and a second wall member adapted to be joined along contact surfaces to form a wildlife protective cover enclosing the connection to the equipment;

a plurality of aligned entry slots formed in the wall members for passage of a wire into an interior portion of the cover; and a lock mechanism, comprising:

a receiving channel member formed having side leg portions extending outwardly from an outer surface of one of the wall members adjacent its contact surface;

the receiving channel member defining a slot between the side leg portions extending from the wall member outer surface on which the receiving channel member is formed;

a locking tongue member formed on an outer surface of the other of the wall members adjacent its contact surface;

the locking tongue member having a base member extending outwardly from the outer surface of the wall member on which it is formed;

the locking tongue member having a laterally extending finger adapted to extend from the base member across the contact surface and fit into the slot ofthe receiving channel member when the wall members are joined; and the locking tongue having a detent formed extending from an inner end of the finger to engage a portion of the receiving channel member to lock the tongue and receiving channel member together.

24. The wildlife guard of claim 23, wherein the locking tongue member and receiving channel member are integrally formed with their respective wall members.

25. The wildlife guard of claim 23, wherein the laterally extending finger of the locking tongue member is yieldable under pressure to permit the detent to be moved out of engagement with the receiving channel member for unlocking purposes.

26. The wildlife guard of claim 23, wherein the lock mechanism comprises:

a plurality of receiving channel members formed having side leg portions extending outwardly from an outer surface of one of the wall members adjacent its contact surface;

each of the receiving channel members defining a slot between the side leg portions extending from the wall member outer surface on which the receiving channel members are formed;

a plurality of locking tongue members formed on an outer surface of the other of the wall members adjacent its contact surface;

each of the locking tongue members having a base member extending outwardly from the outer surface of the wall member on which the locking tongue members are formed;

each of the locking tongue members having a laterally extending finger adapted to extend from its base member across the contact surface and fit into the slot of the receiving channel member when the wall members are joined; and each of the locking tongue members having a detent formed extending from an inner end of its finger to engage a portion of one of the receiving channel members to lock the tongue and receiving channel member together.

27. The wildlife guard of claim 26, wherein the locking tongue members and receiving channel members are integrally formed with their respective wall members.

28. The wildlife guard of claim 26, wherein the laterally extending fingers of each of the locking tongue members are yieldable under pressure to permit the detent thereof to be moved out of engagement with the receiving channel member for unlocking purposes.

29. The wildlife guard of claim 26, further including:

an entry slot formed in the wall members adjacent their contact surfaces for passage of a wire into the cover.

30. The wildlife guard of claim 29, further including:

the plurality of receiving channel members being located at spaced positions from each other on opposite sides of the entry slot; and the plurality of locking tongue members being located at spaced positions from each other on opposite sides of the entry slot.

31. The wildlife guard of claim 29, further including:

the plurality of receiving channel members being located at spaced positions from each other above and below the entry slot; and the plurality of locking tongue members being located at spaced positions from each other above and below the entry slot.

32. A wildlife guard for enclosing a wire connection on an insulative bushing of electrical power distribution equipment, comprising:

a first wall member and a second wall member adapted to be joined along contact surfaces to form a wildlife protective cover enclosing the connection to the equipment;

a plurality of aligned entry slots formed in the wall members for passage of a wire into an interior portion of the cover;

a base member extending inwardly below the first and second wall members, the base members defining an opening for fitting the cover onto the insulative bushing; the base member comprising:

a plurality of ring members concentrically located about the opening for the insulative bushing; and spacer members mounted between the ring members for connecting said ring members.

33. The wildlife guard of claim 32, wherein said concentrically located ring members are spaced from each other.

34. The wildlife guard of claim 32, wherein the ring members are of increasing diameter extending in concentric location from an innermost ring member adjacent the opening to an outermost ring member.

* * * * *